US010131492B2

(12) United States Patent
Rubino

(10) Patent No.: US 10,131,492 B2
(45) Date of Patent: Nov. 20, 2018

(54) PIZZA BOX

(71) Applicant: INPACT Srl, Giugliano in Campania (NA) (IT)

(72) Inventor: Diego Rubino, Caserta (IT)

(73) Assignee: INPACT SRL, Giugliano in Campania (NA) (IT)

( * ) Notice: Subject to any disclaimer, the term of this patent is extended or adjusted under 35 U.S.C. 154(b) by 31 days.

(21) Appl. No.: 15/370,256

(22) Filed: Dec. 6, 2016

(65) Prior Publication Data

US 2017/0158410 A1 Jun. 8, 2017

(30) Foreign Application Priority Data

Dec. 7, 2015 (IT) ..... UB2015171683 U

(51) Int. Cl.

| | |
|---|---|
| ***B65D 85/36*** | (2006.01) |
| ***B65D 5/42*** | (2006.01) |
| ***B65D 5/66*** | (2006.01) |
| ***B65D 77/24*** | (2006.01) |
| ***B65D 5/30*** | (2006.01) |

(52) U.S. Cl.

CPC ..... *B65D 85/36* (2013.01); *B65D 5/302* (2013.01); *B65D 5/4295* (2013.01); *B65D 5/6655* (2013.01); *B65D 77/245* (2013.01); *B65D 2205/02* (2013.01); *B65D 2585/366* (2013.01)

(58) Field of Classification Search

CPC .. B65D 2585/366; B65D 85/36; B65D 5/302; B65D 5/4295; B65D 5/665; B65D 77/245; B65D 2205/02; A47G 21/001

See application file for complete search history.

(56) References Cited

U.S. PATENT DOCUMENTS

| | | | | |
|---|---|---|---|---|
| 5,014,853 | A * | 5/1991 | Crockett | A47G 21/001 229/103 |
| 5,110,038 | A * | 5/1992 | Pantisano | B65D 5/6626 206/551 |
| D512,915 | S * | 12/2005 | Demaggio | D9/455 |
| 7,004,377 | B2 * | 2/2006 | Metcalf | A47G 21/001 229/101.1 |
| 7,051,919 | B1 * | 5/2006 | Walsh | B65D 5/0005 229/101.1 |
| 2003/0209592 | A1 * | 11/2003 | Lawrence Holden | A47G 21/001 229/103 |
| 2006/0226206 | A1 | 10/2006 | Reap | |

(Continued)

FOREIGN PATENT DOCUMENTS

| | | |
|---|---|---|
| DE | 20 2015 100 572 U1 | 4/2015 |
| IT | 0001416327 A | 8/2014 |
| KR | 2011-0005587 U | 6/2011 |

OTHER PUBLICATIONS

European Search Report issued in Application No. 16202122.4, dated Feb. 17, 2017.

*Primary Examiner* — Corey Skurdal
(74) *Attorney, Agent, or Firm* — Young & Thompson

(57) ABSTRACT

A pizza box having a bottom (1), side walls (3, 4), a front wall (5), a rear wall (6) and a lid (23), joined with the rear wall (6) along a pre-cut line (24) and centrally provided with partially circular cuts (26) with a vent function, the lid (23) having at least one parabola-shaped breaking line (22) so that a tear along each predetermined breaking line (22) of the lid (23) provides a small tray (V).

9 Claims, 2 Drawing Sheets

(56) References Cited

U.S. PATENT DOCUMENTS

2011/0233264 A1* 9/2011 Lombardi ..... B65D 5/20
229/103
2012/0111931 A1* 5/2012 Kimhi ..... B65D 85/36
229/120

* cited by examiner

PIZZA BOX

FIELD OF THE INVENTION

The present invention relates to a pizza box.

PRIOR ART

The same Applicant is owner of the Italian Patent no. 1416327 which describes a pizza box having a bottom, side walls, a front wall, a rear wall and a lid. The pizza box is stackable and reducible in its size according to the needs.

SUMMARY OF THE INVENTION

It would be convenient that this box was also provided with another function, particularly useful when a pizza is consumed on the street, without the availability of fork and knife. This function for the box is to provide a tool to allow a consumer to lift a previously cut slice of pizza from the box, and take it comfortably to the mouth. The above object is achieved by a pizza box as defined in the appended claims.

BRIEF DESCRIPTION OF THE DRAWINGS

Features and advantages will become clearer from the following detailed description relating to an embodiment described with reference to the accompanying drawings, in which.

DESCRIPTION OF AN EMBODIMENT OF THE INVENTION

Figure 1:
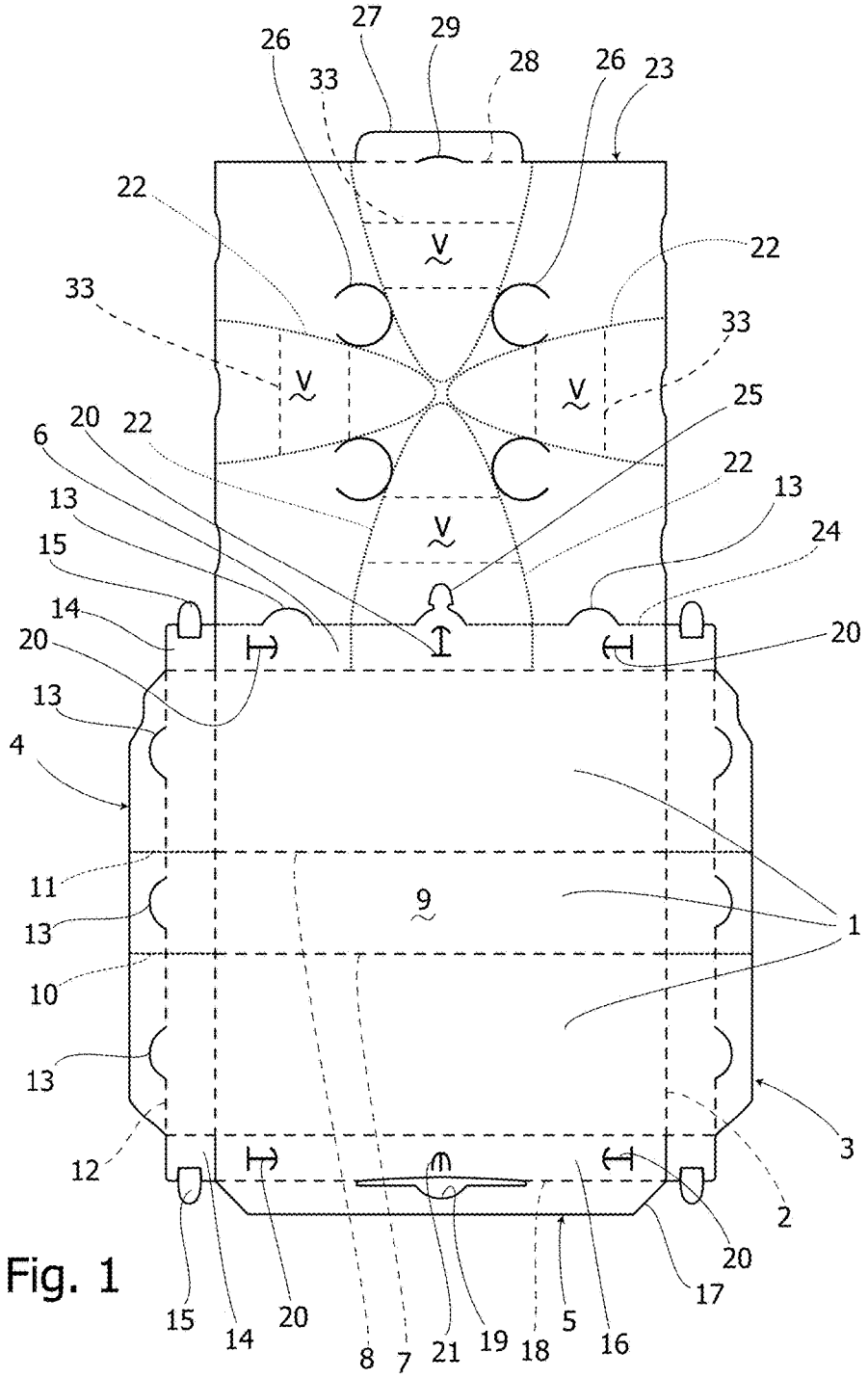
FIG. 1 is a plan view of a die cut for a pizza box according to the present invention.

Reference is made to FIG. 1, which is a plan view of a die cut for the pizza box according to the present invention. The parts of the die cut, which are seen from the inner side of the box once erected, are hereinafter identified with reference to their function in the box. These parts comprise a bottom 1 that is delimited by a continuous creasing line having a rectangular shape and being indicated generally as 2. Along the continuous creasing line 2, the bottom 1 is adjacent to opposite side walls 3, 4, a front wall 5 and a rear wall 6.

In the bottom 1, internally to the continuous creasing line 2, two parallel creasing lines 7, 8, which delimit a central zone 9 of the bottom 1, are formed in the central position during the die-cutting.

The opposite side walls 3, 4 are mirror-like identical, and thus for simplicity only one thereof, for example the side wall 4, is described in detail. In this wall the parallel creasing lines 7, 8 continue in parallel terminal pre-cut lines 10, 11, which are perpendicular to a discontinuous creasing 12 that is externally parallel to an adjacent side of the continuous creasing line 2. The parallel terminal pre-cut lines 10, 11, serve, as known, to reduce the size of the box by their break and bending toward inside the box. The discontinuous creasing 12 is interrupted by crescent-shaped cuts generally indicated as 13, having the convexity facing towards the outside of the die cut. At its front and rear ends, the side wall 4 as well as the side wall 3, is joined to an end portion 14 carrying a tab 15.

The front wall 5 comprises a rectangular part 16 being adjacent, on one side, to the bottom 1 and, on the other side, to a trapezoid part 17. The rectangular part 16 and the trapezoid part 17 are delimited from each other by a creasing line 18 that is interrupted by a slot 19 that looks like a half-flying saucer. The rectangular part 16 of the front wall 5 has two anchor-shaped opposite end cuts 20, 20, and a trident-shaped central cut 21.

The rear wall 6 being adjacent to the bottom 1 along the continuous creasing line 2 is joined with a lid 23, substantially identical to the bottom 1, along a pre-cut line 24. The pre-cut line 24 is interrupted by a pair of crescent-shaped cuts 13 between which a pinnacle-shaped cut 25 is interposed with the tip pointing towards the lid 23. Practiced in the rear wall 6 are two opposite anchor-shaped end cuts 20, 20, and an anchor-shaped cut 20 facing the pinnacle-shaped cut 25.

Centrally formed in the lid 23 are partially circular cuts, with vent function, generically indicated as 26. In the lid 23, four breaking lines 22 have the shape of a parabola that delimits a zone of the lid 23 and terminates in an edge of the lid 23. In the embodiment as shown, the breaking line 22 is tangent to the partially circular cuts 26. A tear along each breaking line 22 of the lid 23 provides a lid zone acting as a small tray V. The breaking lines 22 delimit a pair of creasing lines 33 parallel to each other and to the edge of the lid 23. Their function will be clear later.

An elongated protrusion 27 on the side opposite to the pinnacle-shaped cut 25 is delimited from the rest of the lid 23 with a creasing 28 interrupted by a sickle-shaped cut 29.

Figure 2:
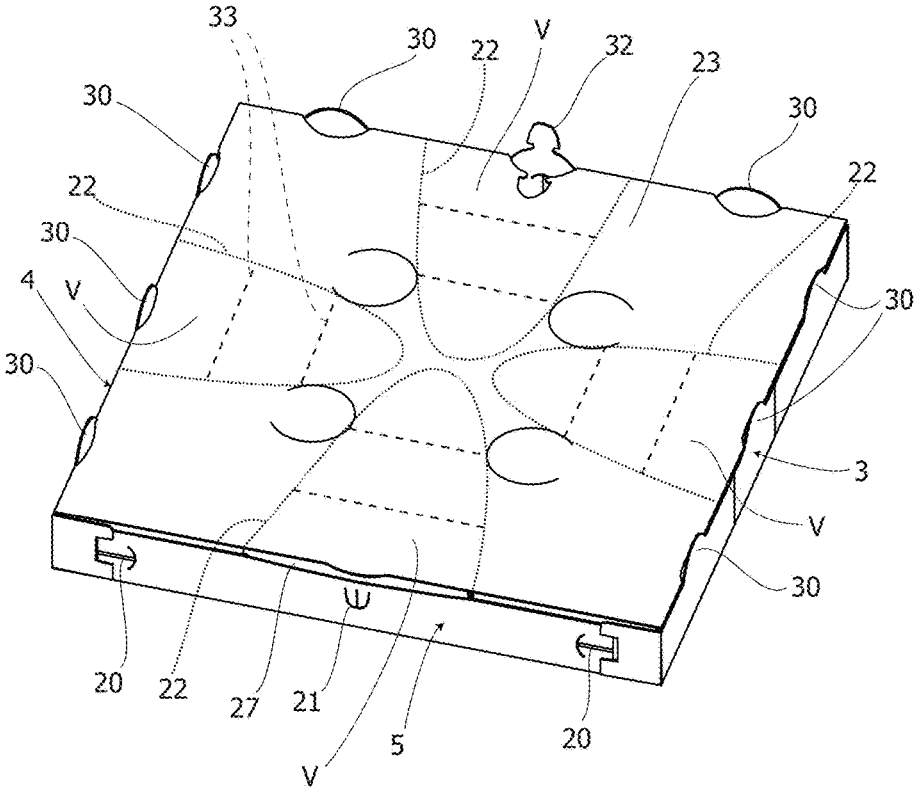
FIG. 2 is a top perspective view showing the box erected from the die cut in FIG. 1.

Reference is made now to FIG. 2, which is a top perspective view of the fully erected box that is obtained from the die cut in FIG. 1. For clarity sake all the lines are shown with the continuous line, differently from FIG. 1.

In FIG. 2, the lid 23 is rotated 90° forward so as to rest on the side walls 3 and 4 and on the front wall 5, more precisely on their portions rotated by 90° towards the inside of the box around the discontinuous creasing 12 and about the creasing line 18, respectively. The protrusion 27 of the lid 23, after a complete rotation, is inserted in the slot 19 of the trapezoid part 17 of the front wall 5. The crescent-shaped elements 30, on the side walls 3, 4 and on the rear wall 5, form lateral, front and rear retaining members, adapted to prevent a shift of an overlying box.

To ensure the maintenance of this arrangement, a pinnacle-shaped element 32 obtained in a box by a pinnacle-shaped cut 25 in a border area between the rear wall 6 and the lid 23, is introduced into the central cut 20 facing towards the pinnacle-shaped cut 25 of the overlying box. The anchor-shaped cuts 20 and the trident-shaped cut 21 have the possibility, once received the tab 15 and the pinnacle-shaped element 32, respectively, to be folded outwardly. This ensures a great grip between the parts and allows to close input and output passages if any for both the content inside the box and foreign substances during transport, such as dust and insects. The closure also allows to maintain the internal temperature.

Briefly, a stacking of more boxes is thus assured, thanks to the crescent-shaped elements 30 of the side walls 3, 4 and the rear wall 6, and to the vertical projections of the front wall 5. The stacking is improved also by the pinnacle-shaped element 32 of an underlying box inserted in the central cut 20 of the overlying box.

As described in the above mentioned Italian Patent n. 1416327, the box according to the present invention can be modified in a reduced size.

This reduced size is convenient when, for example, only a slice of pizza instead of a whole pizza, or a limited number of roasted goods is transported.

Suitably, the material with which the box is made can be corrugated cardboard on the inner side of which a metallized polyester sheet is laminated, particularly suitable to avoid the leakage of oil or other liquids. Alternatively, the polyester sheet can be transparent for allowing the insertion of the box in a microwave oven. The polyester avoids the formation of harmful fumes that are emitted due to the heat of the food from the cardboard in a closed environment. Furthermore, the polyester sheet keeps food warm longer, regardless of the fact that the corrugated cardboard used has the wave covered by sheet of cardboard or that the cardboard wave is uncovered and protected solely and directly by the polyester protective sheet which forms the surface in contact with the food.

The removal of the lid serves both to reduce the size of the box and to exploit the base as a plate to consume the pizza, and still to use the reduced size closable box for storing pizza leftovers or other delicatessen items.

Figure 3:
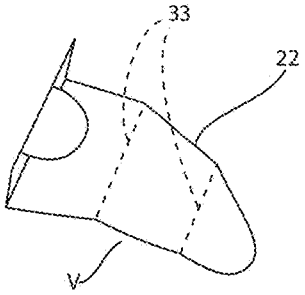
FIG. 3 shows a perspective view of a part of the lid separated from the rest.

According to the present invention the lid 23 may be split by a consumer according to the breaking lines 22 to obtain respective small trays V. Each small tray V, represented in FIG. 3 as a separate part of the lid from the rest and turned upside down, can be used by placing it under a slice of pizza to bring it close to his/her mouth. For consumer convenience, the creasing lines 33 make the small tray V less rigid so that the consumer can handle it comfortably while retaining the pizza to eat it.

It should be evident that in the lid 23, the number of breaking lines 22 may be less than four because each small tray V can be used repeatedly for more slices of pizza to be eaten by the same consumer. The form of the parabola tangent to the partially circular cuts 26 has been chosen to use the maximum available surface of the lid, while maintaining the partially circular cuts 26 useful to allow steam to escape from the pizza.

Alternatively, a different shape for the small trays V can be chosen or the circular partially cuts 26 can be not present.

The invention claimed is:

1. A pizza box comprising a bottom, side walls, a front wall, a rear wall and a lid, wherein the lid has edges, at least one breaking line delimits a zone of the lid beginning and ending in a lid edge, in such a way that a tear along each breaking line in the lid provides a small tray, and a pinnacle-shaped cut is formed in the rear wall in an area adjacent to the lid and forms a pinnacle-shaped element to be inserted in an anchor-shaped cut, being formed centrally in the rear wall of an overlying box in a stacked condition.

2. The pizza box according to claim 1, wherein the at least one breaking line is parabola-shaped.

3. The pizza box according to claim 1, wherein the zone delimited by the at least one breaking line in the lid has at least a pair of parallel creasing lines that are made parallel to the corresponding edge of the lid.

4. The pizza box according to claim 1, wherein the lid is joined with the wall rear along a pre-cut line.

5. The pizza box according to claim 1, wherein the side walls have a discontinuous creasing line interrupted by cuts, the rear wall has cuts which interrupt the pre-cut line, said cuts generating side and rear elements, and the front wall is formed by a rectangular part and by a trapezoid part, both being separated by a creasing line.

6. The pizza box according to claim 5, wherein the cuts on the side walls and on the rear wall are crescent shaped.

7. The pizza box according to claim 1, wherein the side walls have end portions individually supporting a tab to be inserted into a corresponding anchor-shaped cut being made in the front and rear walls.

8. The pizza box according to claim 1, wherein centrally formed in the bottom of the box are two parallel creasing lines which continue on the side walls with terminal pre-cut lines.

9. The pizza box according to claim 1, wherein the lid is provided centrally with partially circular cuts with vent function.

* * * * *